US012331645B2

(12) United States Patent
Kim et al.

(10) Patent No.: US 12,331,645 B2
(45) Date of Patent: Jun. 17, 2025

(54) HIGH-EFFICIENCY SINE ROTARY ENGINE

(71) Applicants: Byeong Woo Kim, Hwaseong-si (KR); Seong Wool Kim, Hwaseong-si (KR)

(72) Inventors: Byeong Woo Kim, Hwaseong-si (KR); Seong Wool Kim, Hwaseong-si (KR)

( * ) Notice: Subject to any disclaimer, the term of this patent is extended or adjusted under 35 U.S.C. 154(b) by 0 days.

(21) Appl. No.: 18/934,216

(22) Filed: Oct. 31, 2024

(65) Prior Publication Data

US 2025/0059891 A1 Feb. 20, 2025

Related U.S. Application Data

(63) Continuation of application No. PCT/KR2024/000349, filed on Jan. 8, 2024.

(30) Foreign Application Priority Data

Mar. 14, 2023 (KR) ..... 10-2023-0033399

(51) Int. Cl.
*F01C 1/344* (2006.01)
*F01C 21/00* (2006.01)

(52) U.S. Cl.
CPC ..... *F01C 1/344* (2013.01); *F01C 21/008* (2013.01)

(58) Field of Classification Search
CPC .. F01C 1/22; F01C 1/344; F01C 17/02; F01C 21/008; F02B 55/02; F02B 55/08
See application file for complete search history.

(56) References Cited

U.S. PATENT DOCUMENTS

| | | | | | |
|---|---|---|---|---|---|
| 1,442,198 | A * | 1/1923 | Utley | F01C 1/344 | 418/150 |
| 2,359,903 | A * | 10/1944 | Fanning | F04C 2/344 | 418/150 |
| 3,610,210 | A * | 10/1971 | Odawara | F02B 75/021 | 418/256 |
| 4,876,850 | A * | 10/1989 | Eickmann | F01B 1/0603 | 60/39.63 |
| 8,210,151 | B2 * | 7/2012 | Drachko | F01C 1/07 | 123/243 |
| 2021/0396231 | A1 * | 12/2021 | Shapovalov | F02B 53/12 | |
| 2025/0059908 | A1 * | 2/2025 | Kim | F02B 53/04 | |

FOREIGN PATENT DOCUMENTS

| | | | |
|---|---|---|---|
| JP | 2014043888 | A | 3/2014 |
| KR | 19930002975 | B1 | 4/1993 |
| KR | 20080042121 | A | 5/2008 |
| KR | 20100032280 | A | 3/2010 |
| KR | 20140014830 | A | 2/2014 |

* cited by examiner

*Primary Examiner* — Jesse S Bogue
(74) *Attorney, Agent, or Firm* — NKL Law; Jae Youn Kim

(57) ABSTRACT

The present invention is related to a high-efficiency sine rotary engine that converts rotational energy by burning fuel or using fluid pressure or transmits a fluid using rotational power, and also relates to technology for reducing friction between components to increase power transmission efficiency and increase a fluid sealing effect.

4 Claims, 10 Drawing Sheets

HIGH-EFFICIENCY SINE ROTARY ENGINE

TECHNICAL FIELD

The present invention relates to a high-efficiency sine rotary engine configured to convert rotational energy using combustion of fuel or pressure of fluid or to transmit fluid through rotational power, and more particularly, to a technique of reducing friction between components so as to improve power transmission efficiency and maximally increase sealing performance for fluid.

BACKGROUND ART

An apparatus capable of converting various types of energy is used in various fields. Examples of the apparatus include an apparatus capable of converting the pressure from various kinds of fluid, such as steam pressure, air pressure, water pressure, and hydraulic pressure, into kinetic energy or electric energy, and an apparatus capable of converting combustible fuel such as fossil fuel into kinetic energy or electric energy based on a chemical reaction of the combustible fuel.

Particularly, in the case of a generator capable of generating a large amount of electric energy, electric energy is generated by rotating a steam turbine using the pressure of steam generated by vaporizing water using high-temperature heat energy.

However, a conventional steam turbine is configured to be rotated by pushing a plurality of blades thereof, and structurally, all steam pressure may not rotate the turbine blades. That is, there is a problem in that energy loss occurs in the process of rotating the turbine blades.

In order to increase power generation efficiency of a generator, it is preferable to provide high torque at lower RPM to the generator instead of providing high RPM to the generator. Here, a reducer is installed on a power shaft of the generator so as to lower the RPM of the generator. However, installation of the reducer causes various problems such as an increase in weight of the generator, energy loss of the generator, and bearing failure of a rotating shaft.

In addition, high torque is required not only for the generator but also for an internal combustion engine using fuel. It is difficult to obtain desired power simply using high RPM, so it is important to provide an appropriate distribution of torque and RPM to the generator and the internal combustion engine.

DISCLOSURE

Technical Problem

Therefore, the present invention has been made in view of the above problems, and it is an object of the present invention to provide a high-efficiency sine rotary engine configured to convert rotational energy using combustion of fuel or pressure of fluid or to transmit fluid through rotational power, in which the sine rotary engine is configured to maximally reduce frictional force or operating load when a reciprocating rotor performs linear reciprocating motion and rotational motion, thereby reducing energy loss and increasing power transmission efficiency.

It is another object of the present invention to provide a high-efficiency sine rotary engine configured to prevent backflow of fluid between an inlet of a rotor housing and an outlet thereof by reinforcing an airtight structure between a power shaft and the rotor housing.

Technical Solution

In accordance with an aspect of the present invention, the above and other objects can be accomplished by the provision of a high-efficiency sine rotary engine including a rotor housing having an inlet pipe and an outlet pipe respectively formed therein, the rotor housing having an inner space formed with a curved inner surface of the rotor housing and configured to allow fluid introduced through the inlet pipe to fill the inner space, a power shaft rotatably installed inside the rotor housing, the power shaft being installed at a position eccentric from a central point of the inner space, a reciprocating rotor formed corresponding to a width of the inner space of the rotor housing and installed through a central portion of the power shaft in a radial direction of the power shaft, wherein the reciprocating rotor is rotated inside the rotor housing while performing linear reciprocating motion in the radial direction of the power shaft according to a rotation angle thereof, and an eccentric shaft formed to have a smaller diameter than a diameter of the power shaft and installed in the rotor housing, wherein the eccentric shaft is connected to a central shaft of the reciprocating rotor and guides the reciprocating rotor such that the reciprocating rotor has a constant rotational orbit, wherein the eccentric shaft performs power transmission through gear coupling between the eccentric shaft and the central shaft of the reciprocating rotor.

A part of an outer circumferential surface of the power shaft may be in contact with an inner surface of the rotor housing, and the rotor housing may have an arch-shaped groove formed in the inner surface thereof in contact with the power shaft, wherein the groove is formed corresponding to a circumference of the power shaft.

The power shaft located in the inner space of the rotor housing may be formed to have a circular shape or an elliptical shape.

The eccentric shaft and the central shaft of the reciprocating rotor may be coupled to each other through a coupling structure of a sun gear and a planetary gear.

The eccentric shaft may have the sun gear coupled to one side thereof in a direction of the reciprocating rotor, wherein the sun gear may have a plurality of planetary gears disposed therearound and engaged with and coupled to an inner side of a ring gear, wherein the planetary gears may include one main planetary gear connected to the central shaft of the reciprocating rotor and remaining auxiliary planetary gears not connected to the reciprocating rotor.

The high-efficiency sine rotary engine may further include a carrier configured to connect the main planetary gear to the auxiliary planetary gears, and a hollow shaft located on an outer periphery of the eccentric shaft such that the hollow shaft is rotated in conjunction with rotation of the carrier.

In accordance with another aspect of the present invention, there is provided a high-efficiency sine rotary engine including a rotor housing having an inlet pipe and an outlet pipe respectively formed therein, the rotor housing having an inner space formed with a curved inner surface of the rotor housing and configured to allow fluid introduced through the inlet pipe to fill the inner space, a power shaft rotatably installed inside the rotor housing, the power shaft being installed at a position eccentric from a central point of the inner space, a reciprocating rotor formed corresponding to a width of the inner space of the rotor housing and installed through a central portion of the power shaft in a radial direction of the power shaft, wherein the reciprocating rotor is rotated inside the rotor housing while performing linear reciprocating motion in the radial direction of the power shaft according to a rotation angle thereof, and an eccentric shaft formed to have a smaller diameter than a diameter of the power shaft and installed in the rotor housing, wherein the eccentric shaft is connected to a central shaft of the reciprocating rotor and guides the reciprocating rotor such that the reciprocating rotor has a constant rotational orbit, wherein the eccentric shaft performs power transmission through shaft coupling with the central shaft of the reciprocating rotor, the eccentric shaft has a guide gear integrally formed on the outer side thereof, the power shaft has a power transmission part formed to be integrated therewith, wherein the power transmission part extends from the inner side of the rotor housing to the outer side thereof, the power transmission part has an eccentric guide gear formed on the inner side thereof, wherein the eccentric guide gear has a diameter larger than a diameter of the guide gear, and the guide gear of the eccentric shaft is coupled to the eccentric guide gear of the power transmission part so as to guide the eccentric shaft.

Advantageous Effects

The present invention provides a high-efficiency sine rotary engine including an eccentric shaft configured to enable power transmission through gear coupling between the eccentric shaft and a central shaft of a reciprocating rotor, thereby making it possible to maximally reduce frictional force or operating load when the reciprocating rotor performs linear reciprocating motion and rotational motion. In this manner, the present invention has an effect of reducing energy loss and increasing power transmission efficiency.

Furthermore, the present invention provides a high-efficiency sine rotary engine having a groove formed in the inner side of a rotor housing and configured to partially come into contact with a power shaft so as to reinforce an airtight structure between the power shaft and the rotor housing, thereby having an effect of preventing backflow of fluid between an inlet of the rotor housing and an outlet thereof.

DESCRIPTION OF DRAWINGS

The above and other objects, features and other advantages of the present invention will be more clearly understood from the following detailed description taken in conjunction with the accompanying drawings, in which.

BEST MODE

Hereinafter, preferred embodiments of the present invention will be described in detail with reference to the attached drawings. In describing the embodiments disclosed herein, when it is determined that a detailed description of publicly known techniques or configurations to which the present invention pertains may obscure the gist of the present invention, detailed description thereof will be omitted.

A high-efficiency sine rotary engine according to the present invention may be used as a device such as a generator configured to generate electric energy by using steam pressure, gas pressure, air pressure, water pressure, hydraulic pressure, and a pressure difference between fluids. Further, the sine rotary engine may be used as an internal combustion engine configured to generate power by causing a combustion reaction using fluid and a combustible material such as fossil fuel. Additionally, the sine rotary engine may be utilized in various ways as a mechanical device such as a pump configured to receive power from the outside and transport fluid.

Figure 1:
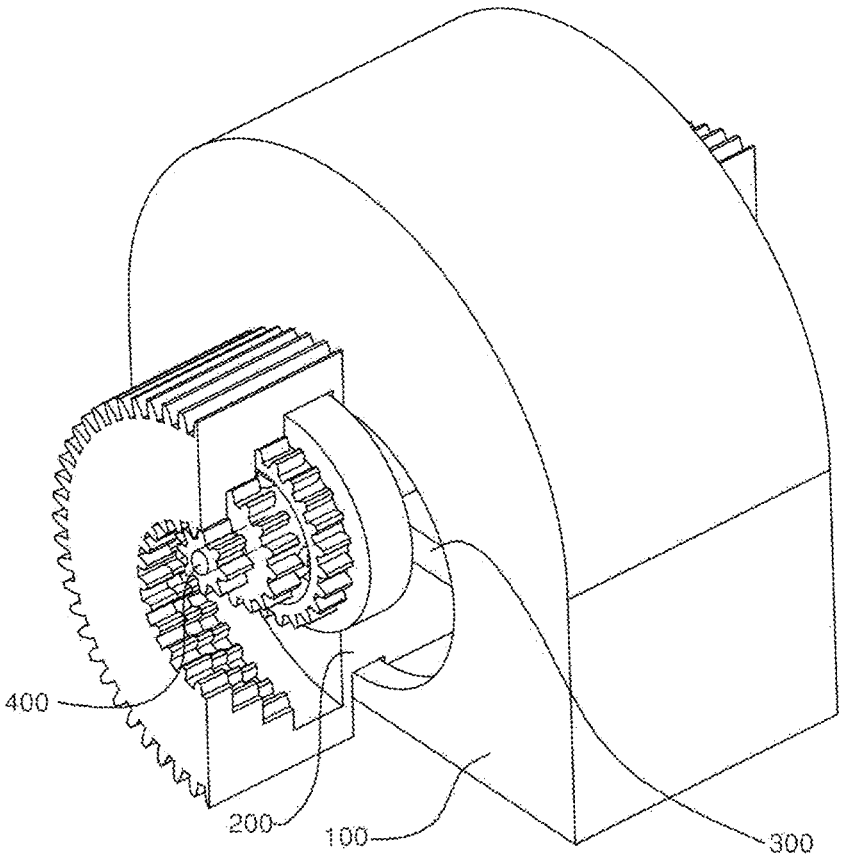
FIG. 1 is a perspective view of a high-efficiency sine rotary engine according to the present invention.
Figure 2:
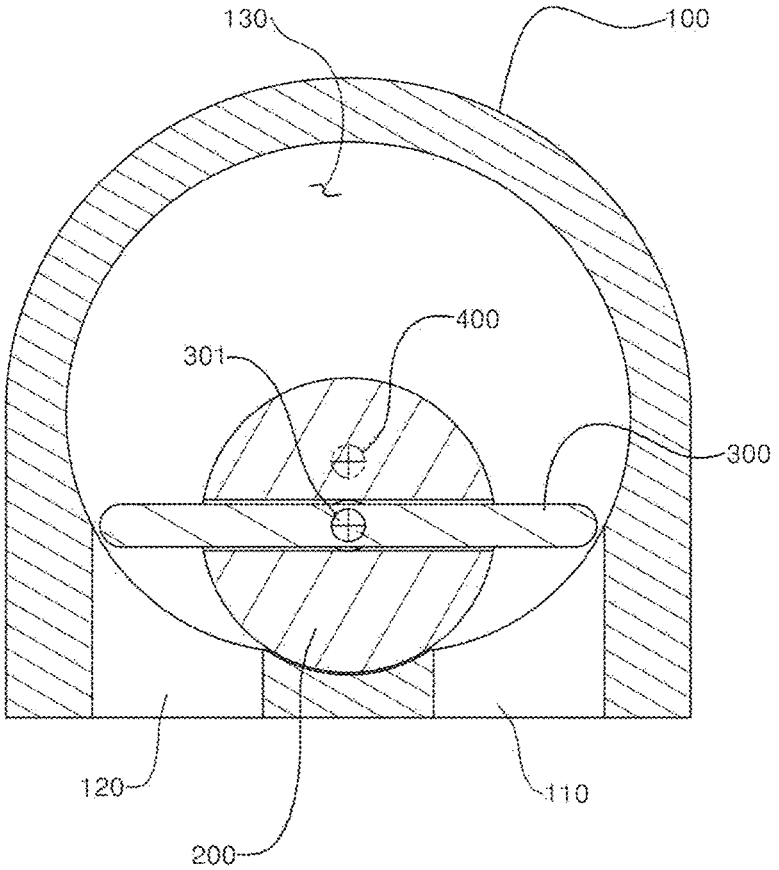
FIG. 2 is a cross-sectional view of an internal structure of the high-efficiency sine rotary engine according to the present invention.
Figure 3:
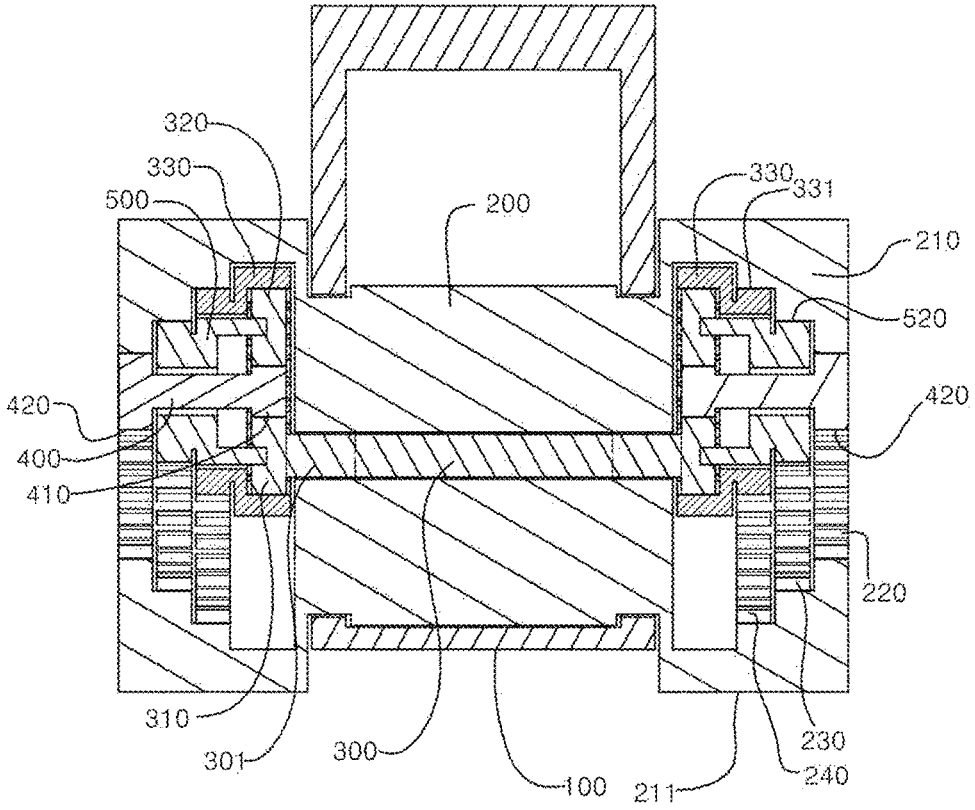
FIG. 3 is a side cross-sectional view of the internal structure of the high-efficiency sine rotary engine according to the present invention.

As shown in FIGS. 1 to 3, the high-efficiency sine rotary engine of the present invention includes a rotor housing 100 having an inlet pipe 110 and an outlet pipe 120 respectively formed therein, in which the rotor housing has an inner space 130 formed with a curved inner surface of the rotor housing and configured to allow fluid introduced through the inlet pipe 110 to fill the inner space, a power shaft 200 rotatably installed inside the rotor housing 100, in which the power shaft 200 is installed at a position eccentric from a central point of the inner space 130, a reciprocating rotor 300 formed corresponding to the width of the inner space 130 of the rotor housing 100 and installed through a central portion of the power shaft 200 in the radial direction, in which the reciprocating rotor is rotated inside the rotor housing 100 while performing linear reciprocating motion in the radial direction of the power shaft 200 according to the rotation angle thereof, and an eccentric shaft 400 formed to have a smaller diameter than a diameter of the power shaft 200 and installed in the rotor housing 100, in which the eccentric shaft is connected to a central shaft 301 of the reciprocating rotor 300 and guides the reciprocating rotor 300 such that the reciprocating rotor 300 has a constant rotational orbit. The eccentric shaft 400 performs power transmission through gear coupling between the eccentric shaft 400 and the central shaft 301 of the reciprocating rotor 300.

According to the configuration of the present invention, the eccentric shaft 400 and the central shaft 301 of the reciprocating rotor 300 are configured to relatively move each other in a state of being coupled to each other through a gear, thereby making it possible to maximally reduce frictional force and operating load due to movement of the reciprocating rotor 300.

Hereinafter, respective components of the present invention will be described in more detail.

As shown in FIG. 2, the rotor housing 100 of the present invention has the inner space 130 formed therein and configured to allow the reciprocating rotor 300 to be rotated therein. In this case, although the shape of the inner space 130 appears to be circular in the drawing, the inner space 130 does not have a perfect circular shape. The internal shape of the rotor housing 100 is determined by a ratio of the length of the reciprocating rotor 300 to the diameter of the eccentric shaft 400. That is, as the diameter of the eccentric shaft 400 becomes smaller, the internal shape of the rotor housing 100 is formed to be closer to a circular shape. On the other hand, when the diameter of the eccentric shaft 400 is relatively large, the rotor housing 100 is formed to have a cardioid shape.

Here, the rotor housing 100 is determined by the following Equation.

$$\sin(\theta)+k \text{ or } \alpha\cos(\theta)+k$$

Here, $\alpha$ represents the diameter of the eccentric shaft 400 (eccentric circle), k represents half of the length of the reciprocating rotor 300, and 2k is equal to the length of the reciprocating rotor 300. The shape of the rotor housing 100 is determined by a ratio of $\alpha$ to k, and the size of the circle of the eccentric shaft 400 is determined for the shape of each rotor housing 100. Here, $\theta$ is an angle from 0 to $2\pi$, which is an angular range for traces of points drawn around an origin according to a value of a polar coordinate equation.

Further, the rotor housing 100 has the inlet pipe 110 and the outlet pipe 120 respectively formed therein. First, the power shaft 200 is installed at a lower portion of the center of the rotor housing 100, and the inlet pipe 110 and the outlet pipe 120 are respectively formed on the left and right sides of the power shaft 200. According to this structural configuration, fluid introduced into the rotor housing 100 makes one rotation inside the rotor housing 100 along the reciprocating rotor 300 and then is discharged from the rotor housing.

As shown in the drawing, the power shaft 200 of the present invention is configured to be rotatably installed inside the rotor housing 100. When used as a power device including a generator, the power shaft is used as a shaft to output power obtained by rotation of the reciprocating rotor 300 to the outside. On the other hand, when used as a fluid transport machine including a pump that receives power from the outside, the power shaft 200 is used as a shaft to rotate the reciprocating rotor.

The power shaft 200 is eccentrically moved from the central point of the rotor housing 100 and is installed at the origin of $\alpha\sin(\theta)+k$ or $\alpha\cos(\theta)+k$. As described above, the power shaft is installed at the lower portion of the center of the rotor housing 100.

The power shaft 200 is installed at a position eccentric from the central point of the rotor housing 100. As described above, the power shaft is installed at the lower portion of the rotor housing 100.

A part of the outer circumferential surface of the power shaft 200 may be in contact with the inner surface of the rotor housing 100. Here, the rotor housing 100 preferably has an arch-shaped groove 131 formed in the inner surface thereof in contact with the power shaft 200, in which the groove is formed corresponding to the circumference of the power shaft 200. As described above, when a part of the power shaft 200 comes into contact with the groove 131, an airtight structure between the power shaft 200 and the rotor housing 100 is strengthened, thereby making it possible to prevent backflow of fluid between the inlet of the sine rotary engine and an outlet thereof.

In addition, the shape of the power shaft 200 located inside the rotor housing 100 is formed not only as a circular shape but also as a curved shape such as an elliptical shape, thereby adjusting a compression ratio in various manners.

Figure 4:
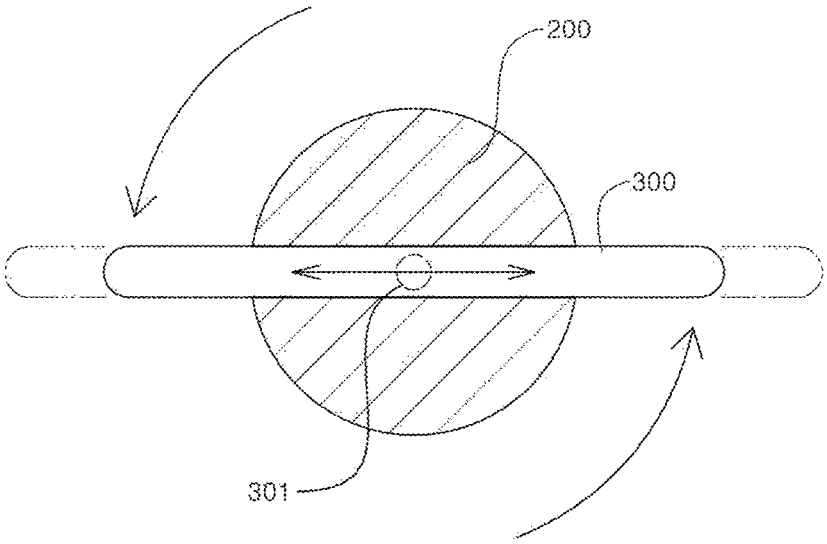
FIG. 4 is a view showing an example of the operation of a power shaft and a reciprocating rotor constituting the high-efficiency sine rotary engine according to the present invention.
Figure 5:
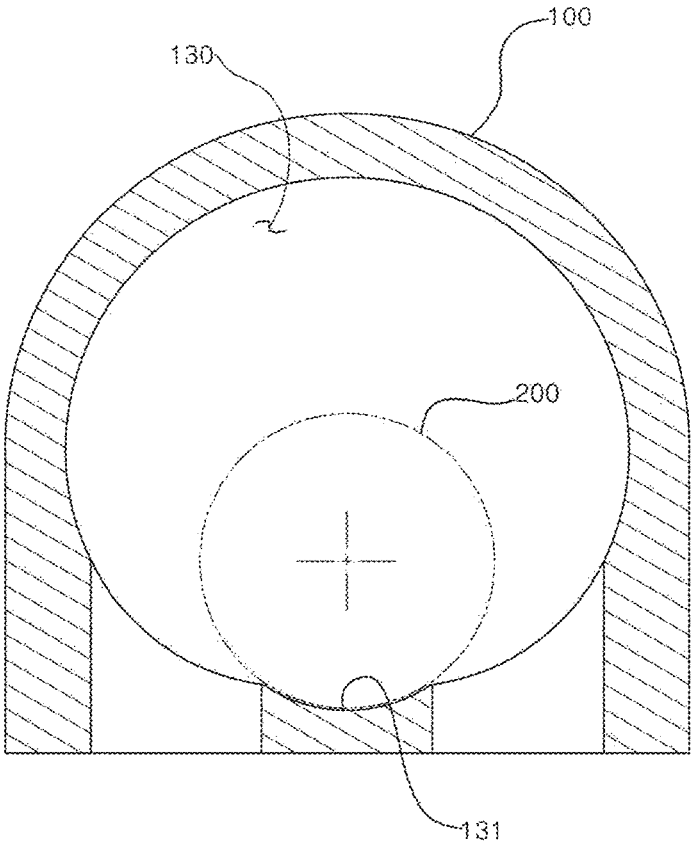
FIG. 5 is a view showing a groove formed in a rotor housing according to the present invention.

The reciprocating rotor 300 of the present invention is configured to be coupled to the power shaft 200 and to be installed through the center of the power shaft 200 in the radial direction. As shown in FIG. 4, the reciprocating rotor 300 is capable of performing linear motion in the radial direction of the power shaft 200.

The reciprocating rotor 300 is rotated by pressure of the introduced fluid. Here, the reciprocating rotor 300 performs, according to the angle of rotation, linear motion while alternately changing the center of the power shaft 200 left and right. When the linear motion is repeatedly performed in a state in which the reciprocating rotor 300 is continuously rotated in this manner, the reciprocating rotor 300 performs linear reciprocating rotation motion.

The length of the reciprocating rotor 300 is formed corresponding to the width of the inner space 130 of the rotor housing 100. The end of the reciprocating rotor 300 may or may not be in contact with the inner wall of the rotor housing 100. When it is required to increase sealing force, the opposite ends of the reciprocating rotor 300 are preferably configured to be in contact with the inner wall of the rotor housing 100. Meanwhile, when it is required to maximally reduce frictional force, it is preferable to form a fine gap between the opposite ends of the reciprocating rotor 300 and the inner wall of the rotor housing 100.

The eccentric shaft 400 of the present invention is configured to guide the reciprocating rotor 300 such that the reciprocating rotor has a constant rotational orbit. Furthermore, the eccentric shaft 400 and the central shaft 301 of the reciprocating rotor 300 are coupled to each other through a coupling structure of a sun gear 410 and a planetary gear.

Figure 6:
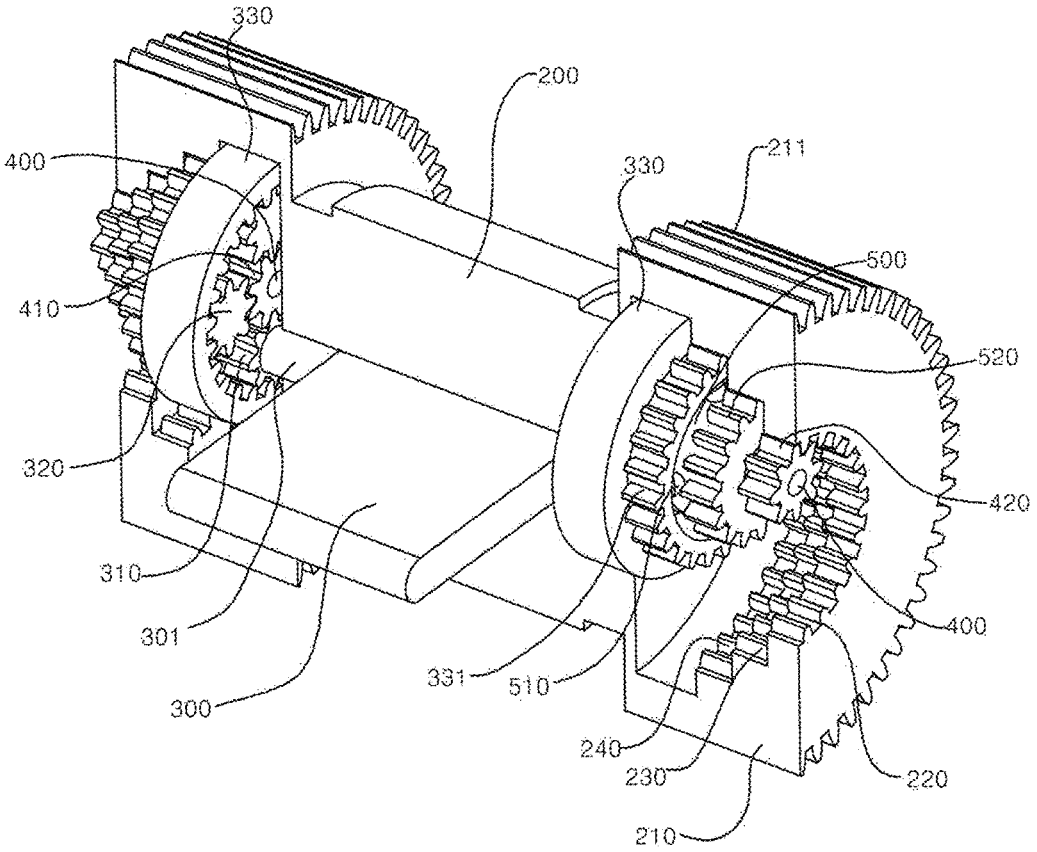
FIGS. 6 and 7 are perspective views each showing a gear coupling structure of the high-efficiency sine rotary engine according to the present invention.
Figure 7:
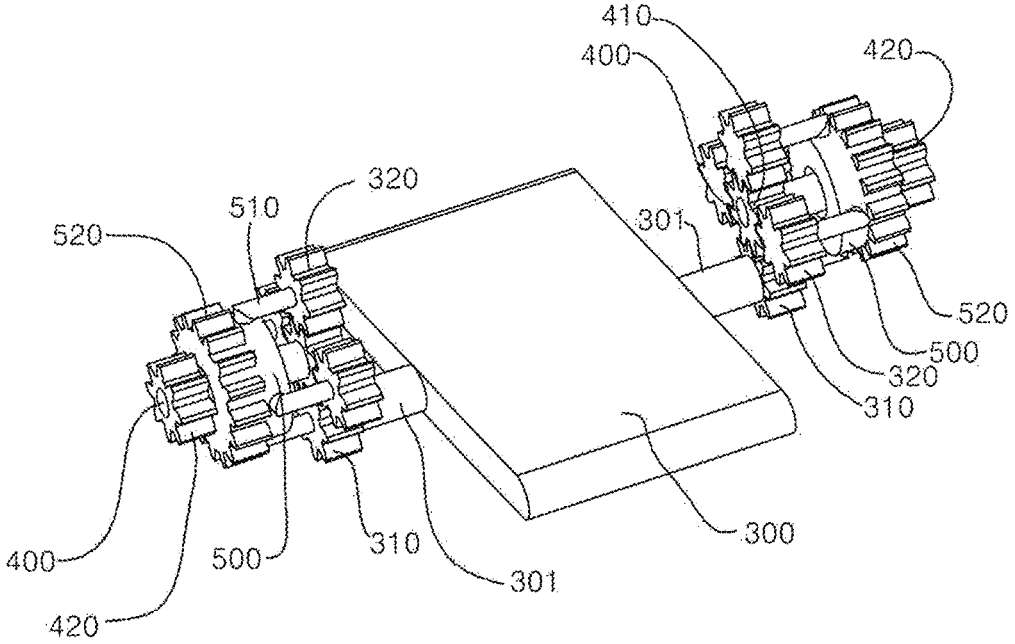

More specifically, as shown in FIG. 3 or FIGS. 6 and 7, the sun gear 410 is coupled to one side of the eccentric shaft 400 in the direction of the reciprocating rotor 300. A plurality of planetary gears is disposed around the sun gear 410 and is engaged with and coupled to the inner side of a ring gear 330. The planetary gears are formed of one main planetary gear 310 connected to the central shaft 301 of the reciprocating rotor 300 and remaining auxiliary planetary gears 320 not connected to the reciprocating rotor 300.

According to the above-described configuration, the main planetary gear 310 connected to the reciprocating rotor 300 is rotated with a constant rotational orbit around the sun gear 410, thereby enabling the main planetary gear to guide the reciprocating rotor 300. Further, since guidance is achieved by engagement between the gears, the reciprocating rotor 300 may significantly reduce physical contact friction during movement thereof and may increase energy efficiency.

The eccentric shaft 400 may be provided only on one side of the reciprocating rotor 300 or may be provided on opposite sides of the reciprocating rotor 300, as shown in the drawing.

The high-efficiency sine rotary engine of the present invention may further include a carrier 510 configured to connect the main planetary gear 310 to the auxiliary planetary gears 320, and a hollow shaft 500 positioned on the outer periphery (outer circumference) of the eccentric shaft 400 such that the hollow shaft is rotated in conjunction with rotation of the carrier 510.

In addition, the power shaft 200 of the present invention may further include a power transmission part 210 formed to extend farther not only into the inner space 130 of the rotor housing 100 but also to the outside of the inner space 130, as shown in the drawing. The power transmission part 210 has a power transmission gear 211 formed on the outer side surface thereof and configured to transmit power to the outside. Further, the power transmission part 210 has a first internal gear 220, a second internal gear 230, and a third internal gear 240 formed on the inner side surface thereof, in which the first internal gear, the second internal gear, and the third internal gear are sequentially formed from the outside of the inner side surface of the power transmission part to the inside thereof.

The first internal gear 220 of the power shaft 200 is engaged with a first external gear 420 formed as the smallest internal gear in the power shaft 200, in which the first external gear is formed on the opposite side of the sun gear 410 of the eccentric shaft 400, the second internal gear 230 thereof is engaged with a second external gear 520 formed on the outer side surface of the hollow shaft 500, and the third internal gear 240 thereof is engaged with a third external gear 331 integrally connected to the ring gear 330, in which the third external gear is connected to the hollow shaft 500 through the carrier 510 and is rotated in conjunction with rotation of the hollow shaft.

Figure 8:
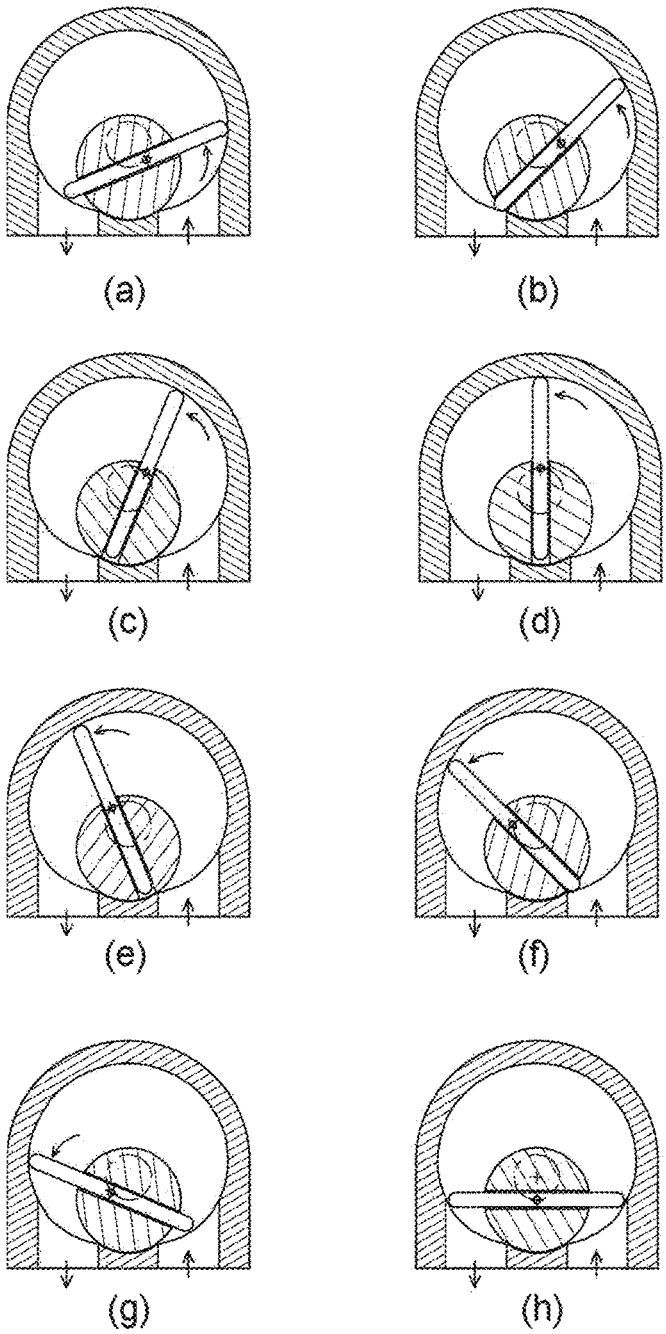
FIG. 8 is a view sequentially showing an example of the operation of the reciprocating rotor according to the present invention.

Movement of the reciprocating rotor 300 of the present invention will be described with reference to FIG. 8 as follows. When fluid is introduced from the outside through the inlet pipe 110, the reciprocating rotor 300 is pushed by the pressure of the introduced fluid and is rotated in one direction. In this process, the reciprocating rotor 300 performs linear reciprocating motion in accordance with a rotational orbit of the central shaft 301 coupled to the eccentric shaft 400 and is rotated inside the rotor housing 100 so as to discharge the fluid through the outlet pipe 120. Finally, the reciprocating rotor rotates the power shaft 200 to generate power or create rotational energy. In this case, referring to FIG. 8, when the eccentric shaft 400 is rotated 360 degrees, the power shaft 200 is rotated 180 degrees, thereby obtaining a rotation ratio in which the power shaft 200 is rotated once while the eccentric shaft 400 is rotated twice.

Figure 9:
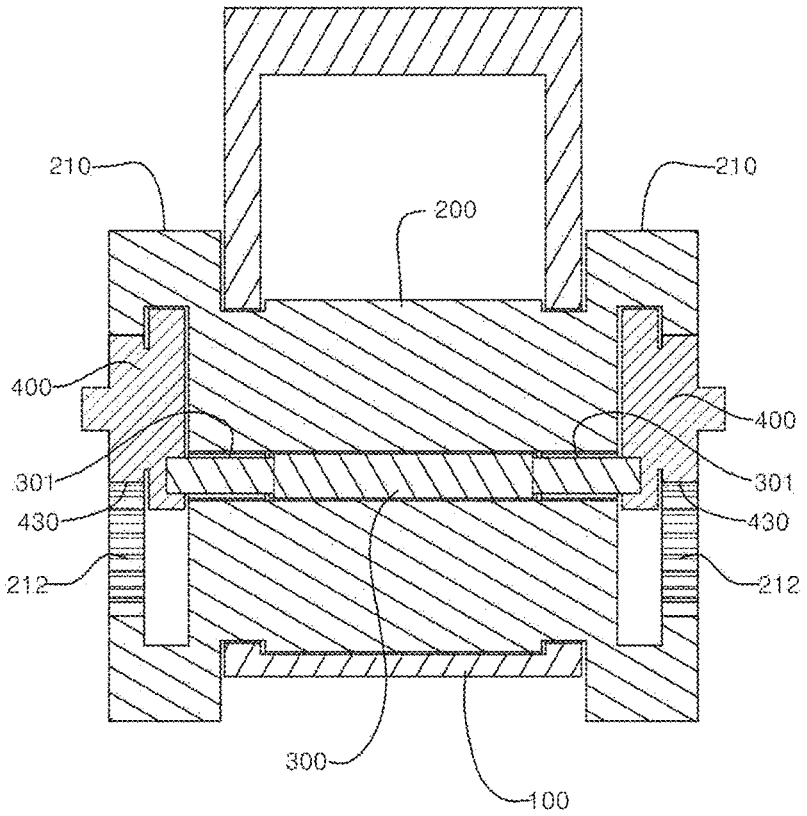
FIG. 9 is a cross-sectional view of a high-efficiency sine rotary engine according to another embodiment of the present invention.
Figure 10:
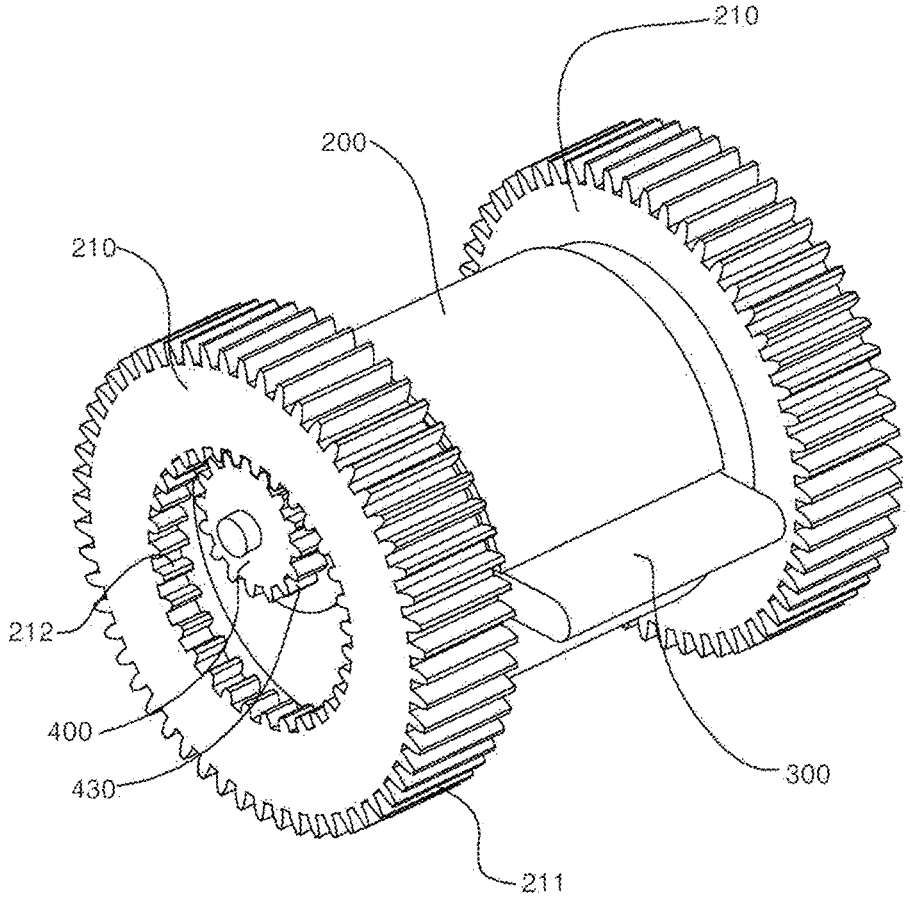
FIG. 10 is a perspective view of the structure of a power shaft and an eccentric shaft applied to another embodiment of the present invention.

FIGS. 9 and 10 are views each showing a high-efficiency sine rotary engine according to another embodiment of the present invention. The high-efficiency sine rotary engine according to another embodiment includes a rotor housing 100 having an inlet pipe 110 and an outlet pipe 120 respectively formed therein, in which the rotor housing has an inner space 130 formed with a curved inner surface of the rotor housing and configured to allow fluid introduced through the inlet pipe 110 to fill the inner space, a power shaft 200 rotatably installed inside the rotor housing 100, in which the power shaft 200 is installed at a position eccentric from a central point of the inner space 130, a reciprocating rotor 300 formed corresponding to the width of the inner space 130 of the rotor housing 100 and installed through a central portion of the power shaft 200 in the radial direction, in which the reciprocating rotor is rotated inside the rotor housing 100 while performing linear reciprocating motion in the radial direction of the power shaft 200 according to the rotation angle thereof, and an eccentric shaft 400 formed to have a smaller diameter than a diameter of the power shaft 200 and installed in the rotor housing 100, in which the eccentric shaft is connected to a central shaft 301 of the reciprocating rotor 300 and guides the reciprocating rotor 300 such that the reciprocating rotor 300 has a constant rotational orbit.

The eccentric shaft 400 performs power transmission through shaft coupling with the central shaft 301 of the reciprocating rotor 300. Further, the eccentric shaft 400 has a guide gear 430 integrally formed on the outer side thereof.

The power shaft 200 has a power transmission part 210 formed to be integrated therewith, in which the power transmission part extends from the inner side of the rotor housing 100 to the outer side thereof. The power transmission part 210 has an eccentric guide gear 212 formed on the inner side thereof. Here, the diameter of the eccentric guide gear is twice the diameter of the guide gear. The guide gear 430 of the eccentric shaft 400 is coupled to the eccentric guide gear 212 of the power transmission part 210 so as to guide the eccentric shaft 400.

In the present embodiment, the eccentric shaft 400 on which the guide gear 430 is formed is directly coupled to the central shaft 301 of the reciprocating rotor 300, and the eccentric shaft 400 is guided with a predetermined orbit along the eccentric guide gear 212.

Although preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A high-efficiency sine rotary engine comprising:

a rotor housing (100) having an inlet pipe (110) and an outlet pipe (120) respectively formed therein, the rotor housing having an inner space (130) formed with a curved inner surface of the rotor housing and configured to allow fluid introduced through the inlet pipe (110) to fill the inner space;

a power shaft (200) rotatably installed inside the rotor housing (100), the power shaft being installed at a position eccentric from a central point of the inner space (130);

a reciprocating rotor (300) formed corresponding to a width of the inner space (130) of the rotor housing (100) and installed through a central portion of the power shaft (200) in a radial direction of the power shaft, wherein the reciprocating rotor is rotated inside the rotor housing (100) while performing linear reciprocating motion in the radial direction of the power shaft (200) according to a rotation angle thereof; and an eccentric shaft (400) formed to have a smaller diameter than a diameter of the power shaft (200) and installed in the rotor housing (100), wherein the eccentric shaft is connected to a central shaft (301) of the reciprocating rotor (300) and guides the reciprocating rotor (300) such that the reciprocating rotor has a constant rotational orbit, wherein:

the eccentric shaft (400) performs power transmission through gear coupling between the eccentric shaft and the central shaft (301) of the reciprocating rotor (300), and a part of an outer circumferential surface of the power shaft (200) is in contact with an inner surface of the rotor housing (100), and the rotor housing (100) has an arch-shaped groove (131) formed in the inner surface thereof in contact with the power shaft (200), wherein the groove is formed corresponding to a circumference of the power shaft (200).

2. The high-efficiency sine rotary engine according to claim 1, wherein the power shaft (200) located in the inner space (130) of the rotor housing (100) is formed to have a circular shape or an elliptical shape.

3. A high-efficiency sine rotary engine comprising:

a rotor housing (100) having an inlet pipe (110) and an outlet pipe (120) respectively formed therein, the rotor housing having an inner space (130) formed with a curved inner surface of the rotor housing and configured to allow fluid introduced through the inlet pipe (110) to fill the inner space;

a power shaft (200) rotatably installed inside the rotor housing (100), the power shaft being installed at a position eccentric from a central point of the inner space (130);

a reciprocating rotor (300) formed corresponding to a width of the inner space (130) of the rotor housing (100) and installed through a central portion of the power shaft (200) in a radial direction of the power shaft, wherein the reciprocating rotor is rotated inside the rotor housing (100) while performing linear reciprocating motion in the radial direction of the power shaft (200) according to a rotation angle thereof; and an eccentric shaft (400) formed to have a smaller diameter than a diameter of the power shaft (200) and installed in the rotor housing (100), wherein the eccentric shaft is connected to a central shaft (301) of the reciprocating rotor (300) and guides the reciprocating rotor (300) such that the reciprocating rotor has a constant rotational orbit, wherein:

the eccentric shaft (400) performs power transmission through gear coupling between the eccentric shaft and the central shaft (301) of the reciprocating rotor (300), the eccentric shaft (400) and the central shaft (301) of the reciprocating rotor (300) are coupled to each other through a coupling structure of a sun gear (410) and a planetary gear, and the eccentric shaft (400) has the sun gear (410) coupled to one side thereof in a direction of the reciprocating rotor (300), wherein the sun gear (410) has a plurality of planetary gears disposed therearound and engaged with and coupled to an inner side of a ring gear (330), wherein the planetary gears comprise one main planetary gear (310) connected to the central shaft (301) of the reciprocating rotor (300) and remaining auxiliary planetary gears (320) not connected to the reciprocating rotor (300).

4. The high-efficiency sine rotary engine according to claim 3, further comprising:

a carrier (510) configured to connect the main planetary gear (310) to the auxiliary planetary gears (320); and a hollow shaft (500) located on an outer periphery of the eccentric shaft (400) such that the hollow shaft is rotated in conjunction with rotation of the carrier (510).

* * * * *